US008506029B2

(12) United States Patent
Isozaki et al.

(10) Patent No.: US 8,506,029 B2
(45) Date of Patent: Aug. 13, 2013

(54) LIQUID DROPLET CIRCULATION CONTROL APPARATUS, LIQUID DROPLET EJECTION APPARATUS, AND COMPUTER READABLE STORAGE MEDIUM

(75) Inventors: Jun Isozaki, Kanagawa (JP); Masaki Kataoka, Kanagawa (JP); Koji Furukawa, Kanagawa (JP); Hiroshi Shibata, Kanagawa (JP)

(73) Assignees: Fuji Xerox Co., Ltd., Tokyo (JP); Fujifilm Corporation, Tokyo (JP)

( * ) Notice: Subject to any disclaimer, the term of this patent is extended or adjusted under 35 U.S.C. 154(b) by 330 days.

(21) Appl. No.: 12/916,816

(22) Filed: Nov. 1, 2010

(65) Prior Publication Data

US 2011/0316904 A1 Dec. 29, 2011

(30) Foreign Application Priority Data

Jun. 25, 2010 (JP) ..... 2010-145223

(51) Int. Cl.
*B41J 29/38* (2006.01)

(52) U.S. Cl.
USPC ..... 347/6; 347/14; 347/85

(58) Field of Classification Search
USPC ..... 347/6–9, 14, 85
See application file for complete search history.

(56) References Cited

U.S. PATENT DOCUMENTS

| | | | | |
|---|---|---|---|---|
| 5,956,062 | A | 9/1999 | Omata et al. | |
| 2006/0066652 | A1 * | 3/2006 | Sugahara | 347/9 |
| 2008/0297546 | A1 * | 12/2008 | Lee et al. | 347/6 |
| 2009/0040248 | A1 * | 2/2009 | Matsuda et al. | 347/6 |
| 2009/0309941 | A1 * | 12/2009 | Price et al. | 347/86 |

FOREIGN PATENT DOCUMENTS

| | | |
|---|---|---|
| JP | A-8-244250 | 9/1996 |
| JP | A-2005-305764 | 11/2005 |

OTHER PUBLICATIONS

Machine English Translation of JP 08-244250.*

* cited by examiner

*Primary Examiner* — Julian Huffman
*Assistant Examiner* — Sharon A Polk
(74) *Attorney, Agent, or Firm* — Oliff & Berridge, PLC

(57) ABSTRACT

There is provided a liquid droplet circulation control apparatus including: a first circulation controller that sets a first circulation mode in which liquid is circulated with pressure control by driving a supply side pressure generator and a return side pressure generator, the supply side pressure generator supplying the liquid to the liquid droplet ejector and the return side pressure generator returning the liquid from the liquid droplet ejector; a second circulation controller that sets a second circulation mode in which the liquid is circulated by driving the supply side pressure generator and/or the return side pressure generator, such that the liquid is made to bypass at least the liquid droplet ejector; a selector that selects one or other circulation modes; and a setting unit that sets a circulation path of the liquid based on the selected circulation mode.

4 Claims, 11 Drawing Sheets

BACK PRESSURE DIFFERENCE AT NOZZLE FACE $$\Delta P = (Pout + hout \times g \times \rho) - (Pin + hin \times g \times \rho)$$

BACK PRESSURE AT NOZZLE FACE $$Pnzl = (Pin + (hin \times g \times \rho) + Pout + hout \times g \times \rho)/2$$

FIG.7

118

ROM

| CIRCULATION MODE / VALVE NAME | FIRST CIRCULATION MODE | SECOND CIRCULATION MODE | | |
|---|---|---|---|---|
| | | FIRST CIRCULATION PATH | SECOND CIRCULATION PATH | THIRD CIRCULATION PATH |
| SUPPLY SIDE VALVE 22 | OPEN | CLOSE | CLOSE | CLOSE |
| RETURN SIDE VALVE 26 | OPEN | CLOSE | CLOSE | CLOSE |
| FIRST COMMUNICATION VALVE 36 | CLOSE | OPEN | CLOSE | CLOSE |
| SECOND COMMUNICATION VALVE 38 | OPEN | CLOSE | CLOSE | CLOSE |
| SUPPLY SIDE AIR VALVE 66 | CLOSE | CLOSE | CLOSE | CLOSE |
| RETURN SIDE AIR VALVE 88 | CLOSE | CLOSE | CLOSE | CLOSE |
| SUPPLY SIDE DRAIN VALVE 70 | CLOSE | CLOSE | OPEN | CLOSE |
| RETURN SIDE DRAIN VALVE 92 | CLOSE | OPEN | CLOSE | OPEN |

LIQUID DROPLET CIRCULATION CONTROL APPARATUS, LIQUID DROPLET EJECTION APPARATUS, AND COMPUTER READABLE STORAGE MEDIUM

CROSS-REFERENCE TO RELATED APPLICATION

This application is based on and claims priority under 35 USC 119 from Japanese Patent Application No. 2010-145223 filed on Jun. 25, 2010.

BACKGROUND

1. Technical Field

The present invention relates to a liquid droplet circulation control apparatus, a liquid droplet ejection apparatus, and a computer readable storage medium.

2. Related Art

There are conventional inventions that control circulation paths of ink within a liquid droplet ejection apparatus.

SUMMARY

A liquid droplet circulation control apparatus including: a first circulation controller that sets a first circulation mode in which liquid is circulated with pressure control by driving a supply side pressure generator and a return side pressure generator that are disposed on either side of a liquid droplet ejector having nozzles for ejecting liquid droplets, a negative pressure for a back pressure of the nozzles being maintained during the circulation of the liquid, the supply side pressure generator supplying the liquid, which is a collection of the liquid droplets, to the liquid droplet ejector and the return side pressure generator returning the liquid from the liquid droplet ejector; a second circulation controller that sets a second circulation mode in which the liquid is circulated with flow rate control by driving the supply side pressure generator and/or the return side pressure generator, such that the liquid is not supplied to the liquid droplet ejector or is made to bypass at least the liquid droplet ejector; a selector that selects one of the first circulation mode and the second circulation mode; and a setting unit that sets a circulation path of the liquid based on the circulation mode selected by the selector.

BRIEF DESCRIPTION OF THE DRAWINGS

An exemplary embodiment of the present invention will be described in detail based on the following figures, wherein:

FIG. 7 is a schematic diagram of a valve open/close pattern table 118A, for a first circulation mode and second circulation mode (first to third circulation paths), stored on a ROM 118;

FIG. 8 is a flow chart showing a main routine for circulation control according to the present exemplary embodiment for activation when power is switched on;

DETAILED DESCRIPTION

Overall Configuration

Explanation follows regarding an inkjet recording apparatus that ejects ink droplets and records an image on a recording medium, as an example of a liquid droplet ejection apparatus for ejecting liquid droplets in an exemplary embodiment.

Note that the liquid droplet ejection apparatus is not limited to an inkjet recording apparatus. Any apparatus may be employed as the liquid droplet ejection apparatus as long as it is an apparatus that ejects liquid droplets, such as, for example, a color filter fabrication apparatus that ejects ink or the like onto a film or glass to fabricate a color filter, an apparatus for ejecting organic EL liquid droplets onto a substrate to form an EL display panel, an apparatus for ejecting liquid solder onto a substrate to form bumps for component mounting, an apparatus for ejecting a liquid containing a metal to form a wiring pattern, or various types of film forming apparatus that eject liquid droplets to form a film.

Figure 11:
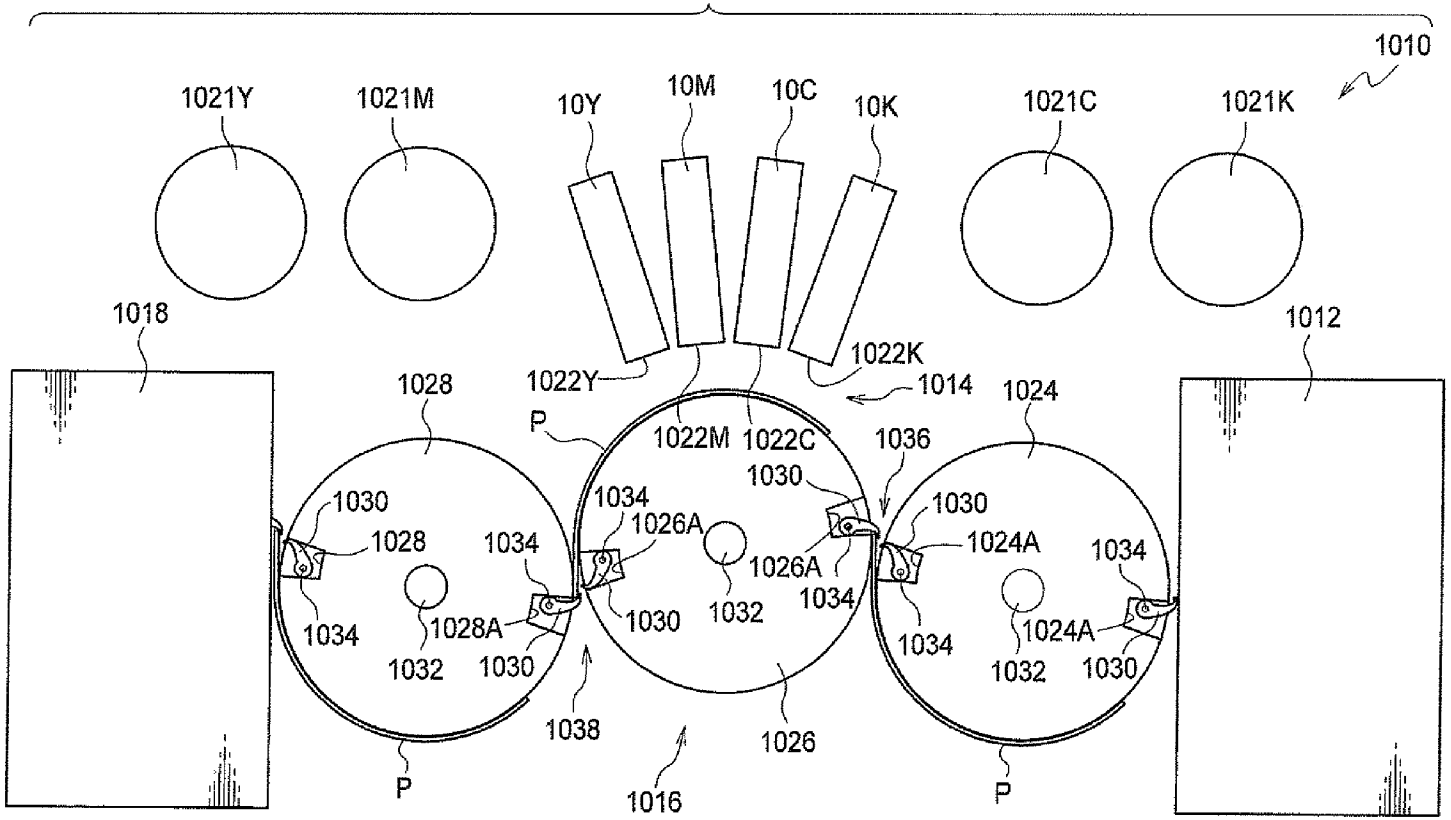
FIG. 11 is a schematic diagram showing a configuration of an inkjet recording apparatus according to the present exemplary embodiment.

FIG. 11 is a schematic diagram showing a configuration of an inkjet recording apparatus according to an exemplary embodiment.

As shown in FIG. 11, the inkjet recording apparatus 1010 includes: a recording medium housing section 1012 in which recording medium P, such as paper, is housed; an image recording section 1014 that records an image on the recording medium P; a conveying unit 1016 that conveys the recording medium P from the recording medium housing section 1012 to the image recording section 1014; and a recording medium discharge section 1018 into which the recording medium P that has been recorded with an image by the image recording section 1014 is discharged.

The image recording section 1014 includes inkjet heads 10Y, 10M, 10C, 10K (referred to below as inkjet heads 10Y to 10K) that eject ink droplets and record an image on a recording medium, as examples of a liquid droplet ejection head that ejects liquid droplets.

The inkjet heads 10Y to 10K have nozzle faces 1022Y to 1022K formed with nozzles (not shown in the figures). The nozzle faces 1022Y to 1022K have a recordable region that is of the same order as or of an order greater than the maximum width of the recording medium P anticipated to be employed for image recording in the inkjet recording apparatus 1010.

The inkjet heads 10Y to 10K are disposed parallel to each other in a row along the recording medium P conveying direction in the color sequence yellow (Y), magenta (M), cyan (C), black (K), from the downstream side. Ink droplets corresponding to each of the colors are ejected from plural nozzles using a piezoelectric method and record an image. Configuration may be made such that a thermal method, or other such method, is employed in the configuration for ejecting ink droplets in the inkjet heads 10Y to 10K.

Ink tanks 1021Y, 1021M, 1021C, 1021K (referred to below as ink tanks 1021Y to 1021K) storing ink for each of the respective colors are provided as storage sections for storing a liquid. Ink is supplied from the ink tanks 1021Y to 1021K to the respective inkjet heads 10Y to 10K. Various inks are employable as the ink supplied to the inkjet heads 10Y to 10K, such as water based inks, oil based inks, solvent system based inks and the like.

The conveying unit 1016 includes: a feed drum 1024 that feeds out the recording medium P inside the recording medium housing section 1012 one sheet at a time; a conveying drum 1026 serving as a conveying body that conveys the recording medium P to the inkjet heads 10Y to 10K of the image recording section 1014 and causes the recording face (front face) of the recording medium P face towards the inkjet heads 10Y to 10K; and a dispatch drum 1028 that feeds the recording medium P onto which an image has been recorded to the recording medium discharge section 1018. The feed drum 1024, conveying drum 1026 and dispatch drum 1028 each respectively retain the recording medium P on their peripheral faces by means of an electrostatic attraction method, or a non-electrostatic attraction method, such as suction, adhesive or the like.

The feed drum 1024, conveying drum 1026 and dispatch drum 1028 are each provided with clippers 1030, for example a pair each, serving as retaining units that nip and retain a portion at the conveying direction downstream side edge of the recording medium P. The three drums 1024, 1026, 1028 are capable of retaining up to two sheets of the recording medium P on their peripheral surfaces by use of the clippers 1030. The clippers 1030 are provided in indentations 1024A, 1026A, and 1028A formed in pairs to the peripheral face of each of the drums 1024, 1026, 1028.

More specifically, rotation shafts 1034 running along the rotation shaft 1032 direction of each of the drums 1024, 1026, 1028 are supported at a predetermined position within the indentations 1024A, 1026A, and 1028A of the drums 1024, 1026, 1028. The plural clippers 1030 are fixed at intervals along the axial direction of the rotation shafts 1034. Accordingly, due to the rotation shafts 1034 being rotated in a forward or reverse direction by actuator(s), not shown in the figures, the clippers 1030 rotate in a forward or reverse direction along the peripheral direction of the drums 1024, 1026, 1028, nipping and retaining, or releasing, the conveying direction downstream side edge portions of the recording medium P.

Namely, due to the clippers 1030 rotating such that the leading end portions of the clippers 1030 protrude out slightly from the peripheral face of each of the drums 1024, 1026, 1028, the recording medium P is passed across from the clippers 1030 of the feed drum 1024 to the clippers 1030 of the conveying drum 1026 at a passing across position 1036 where the peripheral face of the feed drum 1024 faces the peripheral face of the conveying drum 1026. Similarly, the recording medium P is passed across from clippers 1030 of the conveying drum 1026 to the clippers 1030 of the dispatch drum 1028 at a passing across position 1038 where the peripheral face of the conveying drum 1026 faces the peripheral face of the dispatch drum 1028.

The inkjet recording apparatus 1010 is provided with a maintenance unit (not shown in the figures) for maintaining the inkjet heads 10Y to 10K. The maintenance unit has a cap that covers the nozzle faces of the inkjet heads 10Y to 10K, a receiving material that receives ink droplets ejected in preparatory ejection (non-imaging ejection), a cleaning material for cleaning the nozzle faces, an absorbing device for absorbing the ink within the nozzles, and the like. Various types of maintenance are performed by the maintenance unit moving to a facing position that faces the inkjet heads 10Y to 10K.

Explanation follows regarding the image recording operation of the inkjet recording apparatus 1010.

Recording medium P is fed out and retained one sheet at a time from the recording medium housing section 1012 by the clippers 1030 of the feed drum 1024, conveyed while being attracted onto the peripheral face of the feed drum 1024, and passed across from the clippers 1030 of the feed drum 1024 to the clippers 1030 of the conveying drum 1026 at the passing across position 1036.

The recording medium P retained by the clippers 1030 of the conveying drum 1026 is conveyed while being attracted onto the conveying drum 1026 to an image forming position of the inkjet heads 10Y to 10K, and an image is recorded on the recording face of the recording medium P by ink droplets ejected from the inkjet heads 10Y to 10K.

The recording medium P onto which an image has been recorded on the recording face is passed across from the clippers 1030 of the conveying drum 1026 to the clippers 1030 of the dispatch drum 1028 at the passing across position 1038. The recording medium P retained by the clippers 1030 of the dispatch drum 1028 is conveyed while being attracted onto the dispatch drum 1028 and discharged to the recording medium discharge section 1018. A cycle of image recording operation is performed in the above manner.

Pipe Layout Configuration

Figure 1:
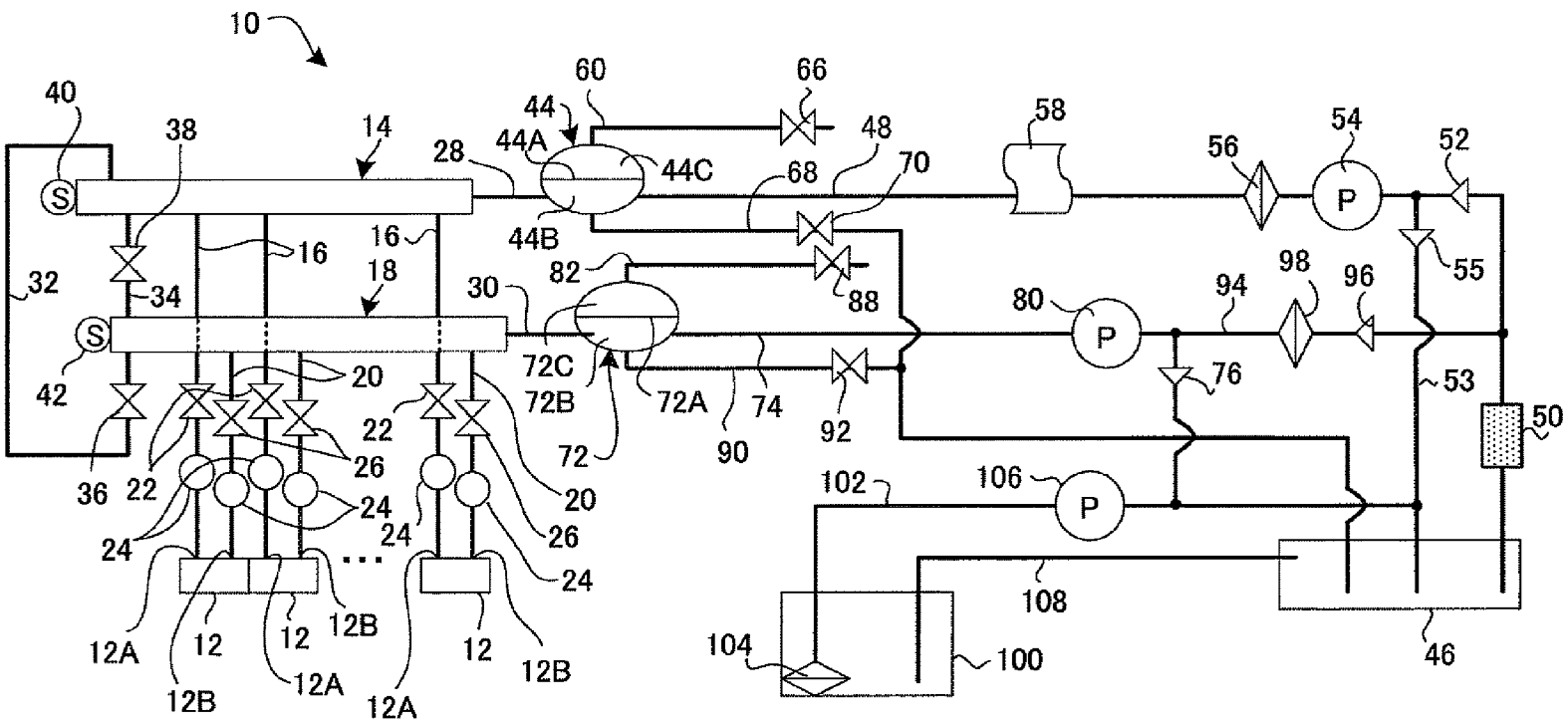
FIG. 1 is a pipe layout diagram of an inkjet head of an inkjet printer according to the present exemplary embodiment.

FIG. 1 is a pipe layout diagram of one of the inkjet heads 10 of an inkjet printer according to the present exemplary embodiment.

The inkjet heads 10 of the present exemplary embodiment are each configured with ink circulation pipe layout paths, attached to plural respective ink droplet ejection portions 12 (called "head modules 12"), for uniformly supplying ink (at constant pressure and constant flow rate) to the head modules 12.

As shown in FIG. 1, an input port 12A into which ink flows and an output port 12B from which ink is discharged are provided to each of the head modules 12. The leading end of a supply side branch pipe 16 that has branched off from a supply side manifold 14 is attached to the input port 12A, and the leading end of a return side branch pipe 20 that has branched off from a return side manifold 18 is attached to the output port 12B. Namely, the branch pipes (the supply side branch pipes 16 and the return side branch pipes 20) are provided to the supply side manifold 14 and the return side manifold 18 in a number that is the number of head modules 12 provided. Ink supplied by the supply side manifold 14 is supplied at a predetermined pressure Pin, and predetermined flow rate to each of the head modules 12. Then the ink that has been supplied to the head modules 12 is returned to the return side manifold 18 at a predetermined pressure P out and predetermined flow rate from each of the head modules 12.

Namely, a difference pressure AP is generated in the head module 12 portions due to the pressure P in of the supply side manifold 14 and the pressure Pout of the return side manifold 18, with this resulting in an ink flow being generated in the head modules 12 between the input port 12A and the output port 12B. Due to such flow, fresh ink is constantly supplied to the head modules 12. A back pressure Pnzl, this being an average total pressure due to high-low difference of the pressure Pin of the supply side manifold 14 and the pressure Pout of the return side manifold 18, is applied to the nozzle face of the ink ejection ports.

A supply side valve 22 and a damper 24 are disposed in each of the supply side branch pipes 16. A return side valve 26 and a damper 24 are disposed in each of the return side branch pipes 20. The supply side valves 22 and the return side valves 26 are present to undertake opening or closing operations as required, in order to independently operate the head modules 12 as required. The dampers 24 are present to dampen out pressure fluctuations and the like during flow operation when ink is supplied from the supply side manifold 14, or when ink is returned to the return side manifold 18.

An end portion of a supply pipe 28 of an ink circulation pipe system is attached to a length direction end portion of the supply side manifold 14 (a portion at the right hand side end in FIG. 1). An end portion of a return pipe 30 of the ink circulation pipe system is attached to a length direction end portion of the return side manifold 18 (a portion at the right hand side in FIG. 1).

A first communication flow path 32 and a second communication flow path 34 are provided between portions at the respective other ends of the supply side manifold 14 and the return side manifold 18 (portions at the left hand side in FIG. 1). A first communication valve 36 is disposed in the first communication flow path 32. A second communication valve 38 is disposed in the second communication flow path 34. The first communication flow path 32 and the second communication flow path 34 are employed for regulation of the pressure and flow rate between the supply side manifold 14 and the return side manifold 18. For example, during normal circulation (flow from the supply side manifold 14 to the return side manifold 18), the first communication valve 36 is closed, the second communication valve 38 is open, and there is only communication through the second communication flow path 34.

A supply side pressure sensor 40 and a return side pressure sensor 42 are also attached at portions at the other end (left hand side in FIG. 1) of the supply side manifold 14 and the return side manifold 18, and these monitor the pressure of ink flow in the supply side manifold 14 and the return side manifold 18.

A portion at the other end of the supply pipe 28 connected to the supply side manifold 14 is connected to a supply side sub-tank 44. The supply side sub-tank 44 has a two chamber structure, partitioned by an elastic thin membrane material 44A, with one of the chambers forming an ink sub-tank chamber 4413 and the other an air chamber 44C.

One end portion of a supply side main pipe 48 for drawing in ink from a buffer tank 46 is connected to the ink sub-tank chamber 4413. An opening at the other end of the supply side main pipe 48 is immersed in ink stored in the buffer tank 46.

Inserted along the supply side main pipe 48 are, in sequence from the buffer tank 46 to the supply side sub-tank 44, a gas elimination module 50, a unidirectional valve 52, a supply side pressure generator 54 (referred to below as a "supply side pump 54"), a supply side filter 56, and an ink temperature regulator 58. While ink stored in the buffer tank 46 is being supplied to the supply side sub-tank 44 by drive force of the supply side pump 54, gas bubbles in the ink are removed and the temperature of the ink is regulated.

A portion at one end of a branch pipe 53 separating from the supply side main pipe 48 is in communication with the input side of the supply side pump 54, and an opening at the other end of the branch pipe 53 is immersed in ink stored in the buffer tank 46, with a unidirectional valve 55 inserted between the two ends.

The supply side pump 54 and the supply side filter 56 applied to the present exemplary embodiment are each tube pumps employing a stepping motor (supplying ink into an elastic tube by rotational driving of the stepping motor), however there is no particular limitation to such a pressure generator (pump). When reference is made below to pump revolution rate this is equivalent to the revolution rate of the stepping motor.

A release pipe 60 is attached to the air chamber 44C of the supply side sub-tank 44. A supply side air valve 66 is disposed in the release pipe 60.

One end of a drain pipe 68 is connected to the ink sub-tank chamber 44B. An opening at the other end of the drain pipe 68 is immersed in ink stored in the buffer tank 46. A supply side drain valve 70 is disposed in the drain pipe 68.

The supply side sub-tank 44 has the role of maintaining a negative pressure for the pressure in the ink sub-tank chamber 44B by use of the air chamber 44C and the thin membrane material 44A.

A portion at the other end of the return pipe 30 connected to the return side manifold 18 is connected to a return side sub-tank 72. The return side sub-tank 72 is of a two chamber structure, partitioned by an elastic thin membrane material 72A, with one of the chambers being an ink sub-tank chamber 7213 and the other being an air chamber 72C.

A portion at one end of a return side main pipe 74 for drawing in ink from the buffer tank 46 is connected to the ink sub-tank chamber 72B.

A unidirectional valve 76 is disposed in the return side main pipe 74, and ink in the return side sub-tank 72 is returned to the buffer tank 46 by drive force of a return side pressure generator 80 (referred to below as a "return side pump 80").

A release pipe 82 is attached to the chamber 72C of the return side sub-tank 72. A return side air valve 88 is disposed in the release pipe 82.

One end of a drain pipe 90 is connected to the ink sub-tank chamber 72B. The other end of the drain pipe 90 is in communication with the drain pipe 68 of the supply side sub-tank 44 via a return side drain valve 92.

The return side sub-tank 72 has the roll of maintaining a negative pressure for the pressure within the ink sub-tank chamber 72B, using the chamber 72C and the thin membrane material 72A.

In the present exemplary embodiment, the pressure due to the supply side pump 54 and the return side pump 80 is such that pressure Pin of the supply side manifold 14>pressure Pout of the return side manifold 18, however these are both respectively negative pressure supply. Namely, the supply pressure of the supply side pump 54 is a negative pressure, however, since the return pressure of the return side pump 80 is an even greater negative pressure, ink flows from the supply side manifold 14 to the return side manifold 18, such that a back pressure Pnzl of the nozzles of the head modules 12 ({(Pin+Pout)/2+ρg (hin+hout)/2}, wherein ρ is the ink density, hin is the height from the nozzle face to the supply side manifold 14, and hout is the height from the nozzle face to the return side manifold 18) is maintained as a negative pressure.

Note that in the present exemplary embodiment, a head module 12 pressurizing purge pipe 94 is provided that communicates between the input side of the return side pump 80 and the output side of the gas elimination module 50 in the supply side main pipe 48.

A unidirectional valve 96 and a return side filter 98 are disposed along the pressurizing purge pipe 94, in sequence from the gas elimination module 50 to the return side pump 80.

Namely, configuration is made such that when eliminating gas bubbles and the like by pressurizing the inside of the head modules 12 and discharging the ink therein all at once, in addition to driving the supply side pump 54, the drive direction of the return side pump 80 is reversed to the normal direction, such that ink is supplied from the buffer tank 46 to the return side manifold 18. The drain pipes 68, 90 are used during discharge.

The buffer tank 46 is in communication with a main tank 100 (corresponding to the ink tanks 1021Y, 1021M, 1021C, 1021K shown in FIG. 11). Namely, ink of an amount required for circulating the ink is stored in the buffer tank 46, and this is replenished by ink from the main tank 100 according to ink consumption. Namely, a portion at one end of a replenishment pipe 102 is immersed in the ink stored in the main tank 100. A filter 104 is attached to the opening of this immersed end of the replenishment pipe 102. The replenishment pipe 102 is connected to the input side of a replenishment pressure generator 106 (referred to below as "replenishment pump 106"). The output side of the replenishment pump 106 is piped to the buffer tank 46, and is in communication with an intermediate portion of the drain pipe 90. Ink is replenished into the buffer tank 46 by driving the replenishment pump 106. An overflow pipe 108 is provided between the buffer tank 46 and the main tank 100, such that ink returns to the main tank 100 when excess ink is replenished.

Control System Configuration

Figure 2:
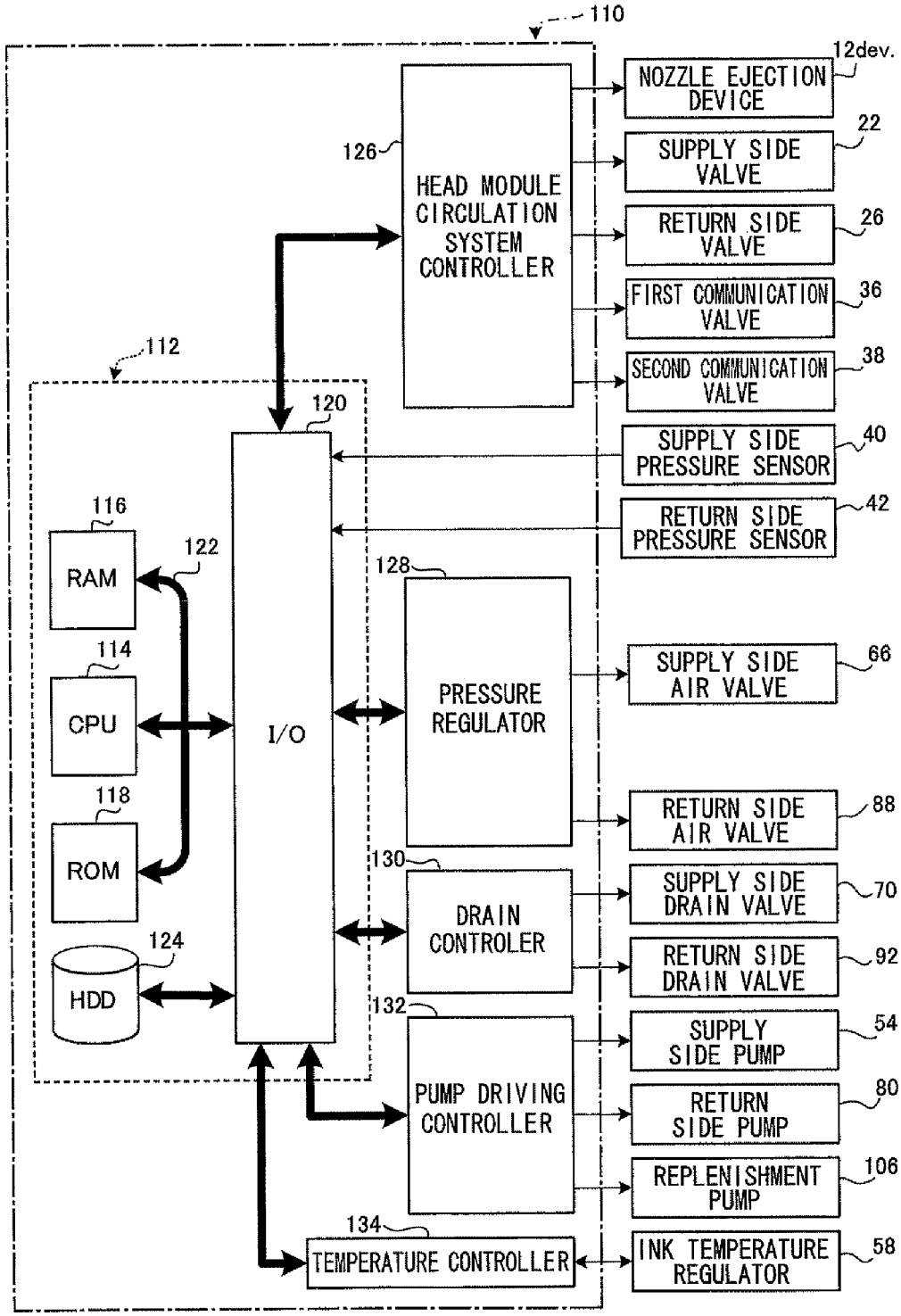
FIG. 2 is a block diagram of an ink supply control device for controlling the operation in an inkjet head according to the present exemplary embodiment.

FIG. 2 shows a block diagram of an ink supply control device 110 for controlling the operation in the inkjet head 10 according to the present exemplary embodiment.

The ink supply control device 110 includes a microcomputer 112. The microcomputer 112 includes a CPU 114, RAM 116, ROM 118, I/O 120 and bus 122, such as a data bus, control bus or the like, that connects these units together.

A Hard Disk Drive (HDD) 124 is connected to the I/O 120. The supply side pressure sensor 40 and the return side pressure sensor 42 are connected to the I/O 120.

Furthermore, whilst not shown in the illustrations, configuration is made such that image data is input to the I/O 120 when ink is ejected from the nozzles of the head modules 12 for image forming. The image data may be data in a state in which the ink ejection position and ejection amount is specified (raster data), or may be compressed data, such as JPEG data, or the like, and in such cases the compressed data is converted into data for ink ejection (raster data) in the CPU 114. An ink circulation system program stored on the ROM 118 is read out and executed in the CPU 114. At least control programs such the following are stored on the ROM 118 for the ink circulation control states (these being the same as "control states" below, and also sometimes referred to as "modes").

First Ink Circulation Mode

The first ink circulation mode is a circulation control program for circulating ink from in the buffer tank 46 in the direction from the supply side manifold 14 to the return side manifold 18 (Program 1).

Second Ink Circulation Mode

The second ink circulation mode is a circulation control program for discharging (purging) gas bubbles generated in the head modules 12 (Program 2).

The programs for executing the first ink circulation mode and the second ink circulation mode are not limited to being stored on the ROM 118, and storage may be made on the HDD 124 or an external storage medium, such that data is read out by installing the external storage medium in a device, so as to be acquired from a reader, a network (neither of these being shown in the figures) such as a LAN or the like.

The CPU 114 reads out the ink circulation control program and, based on the ink circulation control program read out, operates a head module circulation system controller 126, a pressure regulator 128, a drain controller 130, a pump driving controller 132 and a temperature controller 134 that are connected to the I/O 120.

A nozzle ejection device 12 dev. (such as a device that operates to eject ink droplets from nozzles by vibrating a pressure chamber using conduction control to a piezoelectric element or the like) housed in the head modules 12, the supply side valve 22, the return side valve 26, the first communication valve 36, and the second communication valve 38 are connected to the head module circulation system controller 126.

The supply side air valve 66 and the return side air valve 88 are connected to the pressure regulator 128.

The supply side drain valve 70 and the return side drain valve 92 are connected to the drain controller 130.

The supply side pump 54, the return side pump 80, and the replenishment pump 106 are connected to the pump driving controller 132. In the present exemplary embodiment, the rotation speed of the supply side pump 54, the return side pump 80, and the replenishment pump 106 are expressed in revolutions per minute (rpm), however expression may be made in another manner, such as linear velocity, angular velocity or the like.

The ink temperature regulator 58 is connected to the temperature controller 134.

First Ink Circulation Mode

Control is performed in the above first ink circulation mode (controlling circulation such that ink in the buffer tank 46 is caused to circulate by flowing in the direction from the supply side manifold 14 to the return side manifold 18, sometimes referred to below as "first circulation mode") such that the difference pressure AP between the supply side and the return side is constant. Namely, the first ink circulation mode is executed by pressure control (see FIG. 4).

Figure 4:
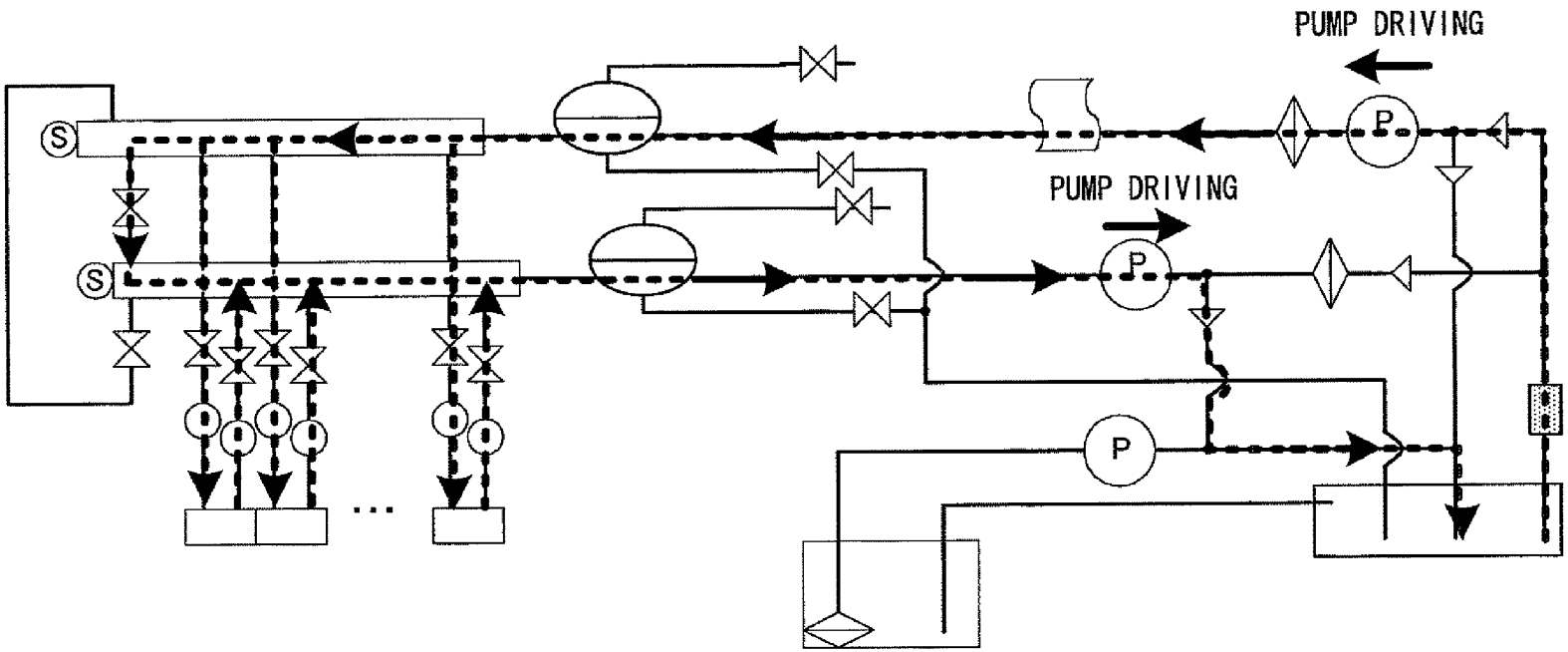
FIG. 4 is a pipe layout diagram showing a circulation path in a first ink circulation mode on the pipe layout diagram of FIG. 1.

Note that FIG. 4 is the same as that of the pipe layout diagram shown in FIG. 1 except that the reference numerals are omitted and the circulation paths are shown in bold broken lines.

Figure 3:
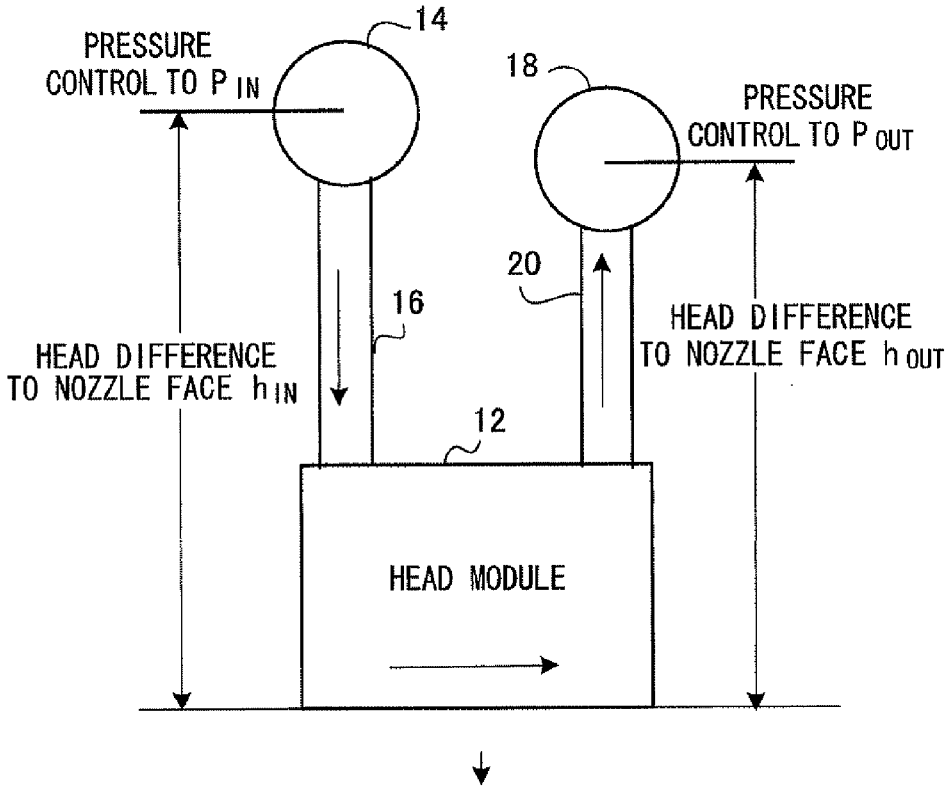
FIG. 3 is a schematic side view for showing a pressure relationship between a supply side manifold and a return side manifold.

FIG. 3 shows schematically the difference pressure AP and the back pressure Pnzl.

As shown in FIG. 3, with reference to the head modules 12, there is a difference between the height position of the supply side manifold 14 and the height position of the return side manifold 18. Accordingly, there is also a difference in the heads thereof from the nozzle face of the head modules 12. The head difference of the supply side manifold 14 to the nozzle face is denoted hin (mm) and the head difference of the return side manifold 18 to the nozzle face is denoted hout (mm).

Ink is supplied to the supply side manifold 14 by a specific pressure Pin due to drive force of the supply side pump 54, and ink is returned to the return side manifold 18 by a specific pressure Pout due to drive force of the return side pump 80. The pressure Pin and the pressure Pout are both negative pressures here, with the pressure Pout being a greater negative pressure than the pressure Pin.

Under the above conditions, the back pressure Pnzl at the nozzle face of the head modules 12 is shown by the following Formula (1).

Under these conditions, the difference pressure AP between the supply side and the return side is shown by the following Formula (2).

$$Pnzl=(Pin+hin\times g\times\rho+Pout+hout\times g\times\rho)/2 \quad (1)$$

$$\Delta P=(Pout+bout\times g\times\rho)-(Pin+bin\times g\times\rho) \quad (2)$$

Wherein:

Pnzl is the pressure (back pressure) at the nozzle face of the head modules 12

Pin is the pressure within the supply side manifold 14

Pout is the pressure within the return side manifold 18 g is the acceleration due to gravity; and

ρ is the ink density.

In Formula (1) and Formula (2), the difference heads bin and hout, and the acceleration due to gravity g can be treated as constant, and when there is no change in the ink, the ink density p may also be treated as constant. Accordingly, adjustment of the difference pressure ΔP and back pressure Pnzl depends on the pressure Pin within the supply side manifold 14 and the pressure Pout within the return side manifold 18.

Second Ink Circulation Mode

In the above second ink circulation mode (controlling circulation in order to discharge gas bubbles occurring in the ink supply paths, sometimes referred to below as "second circulation mode"), in the present exemplary embodiment at least three types of circulation path (first to third circulation paths) are set in which ink does not flow to the head modules 12, and flow rate control is executed by setting these three types of circulation path in succession and driving the supply side pump 54 or the return side pump 80 (see FIGS. 5A and 5B).

First Circulation Path

Figure 5A:
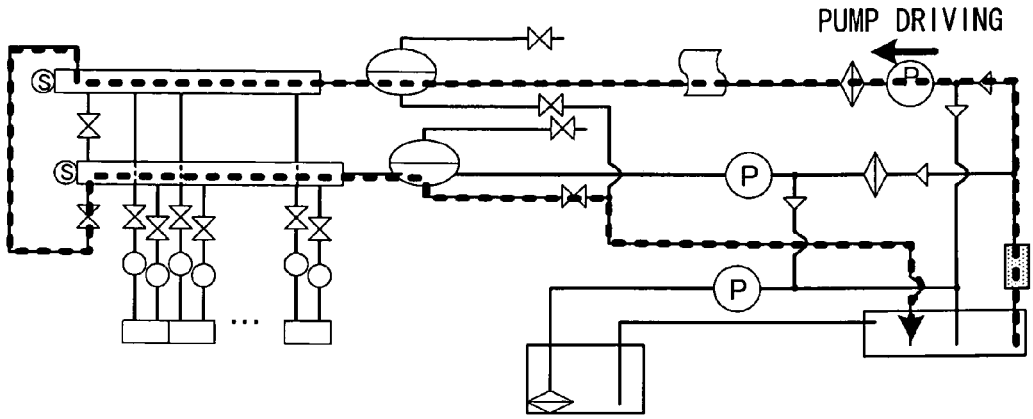
FIG. 5A is a pipe layout diagram showing a first circulation path in a second ink circulation mode.

The first circulation path cuts the flow path from the supply side manifold 14 to the head modules 12 (the supply side branch pipes 16), and the flow path from the head modules 12 to the return side manifold 18 (the return side branch pipes 20) (closes the supply side valve 22 and the return side valve 26), opens the first communication flow path 32 having a larger relative diameter to that of the second communication flow path 34, and controls flow rate by driving the supply side pump 54 (see FIG. 5A).

Note, FIG. 5A is the same as that of the pipe layout diagram shown in FIG. 1 except that the reference numerals are omitted and the circulation path is shown in bold broken lines.

Second Circulation Path

Figure 5B:
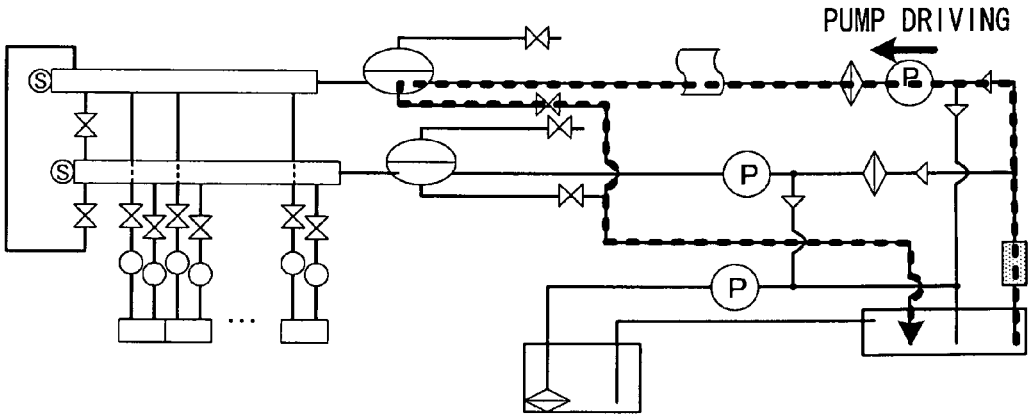
FIG. 5B is a pipe layout diagram showing a second circulation path in the second ink circulation mode.

In the second circulation path, with the supply side main pipe 48 as the main pipe, the supply side drain valve 70 provided to the drain pipe 68 is opened, and flow rate control is made by driving the supply side pump 54 (see FIG. 5B).

Note, FIG. 5B is the same as that of the pipe layout diagram shown in FIG. 1 except that the reference numerals are omitted and the circulation path is shown in bold broken lines.

Third Circulation Path

Figure 5C:
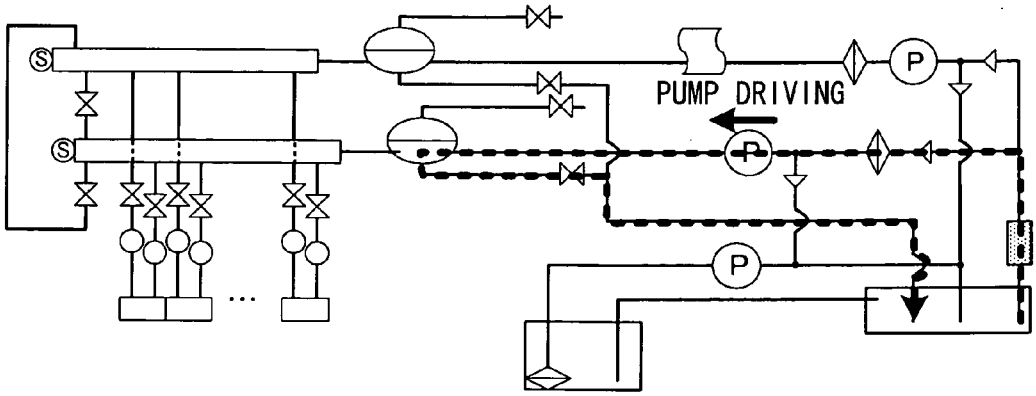
FIG. 5C is a pipe layout diagram showing a third circulation path in the second ink circulation mode.

In the third circulation path, with the return side main pipe 74 as the main pipe, the return side drain valve 92 provided to the drain pipe 90 is opened, and flow rate control is made by driving the return side pump 80 (see FIG. 5C).

Note, FIG. 5C is the same as that of the pipe layout diagram shown in FIG. 1 except that the reference numerals are omitted and the circulation path is shown in bold broken lines.

Figure 6:
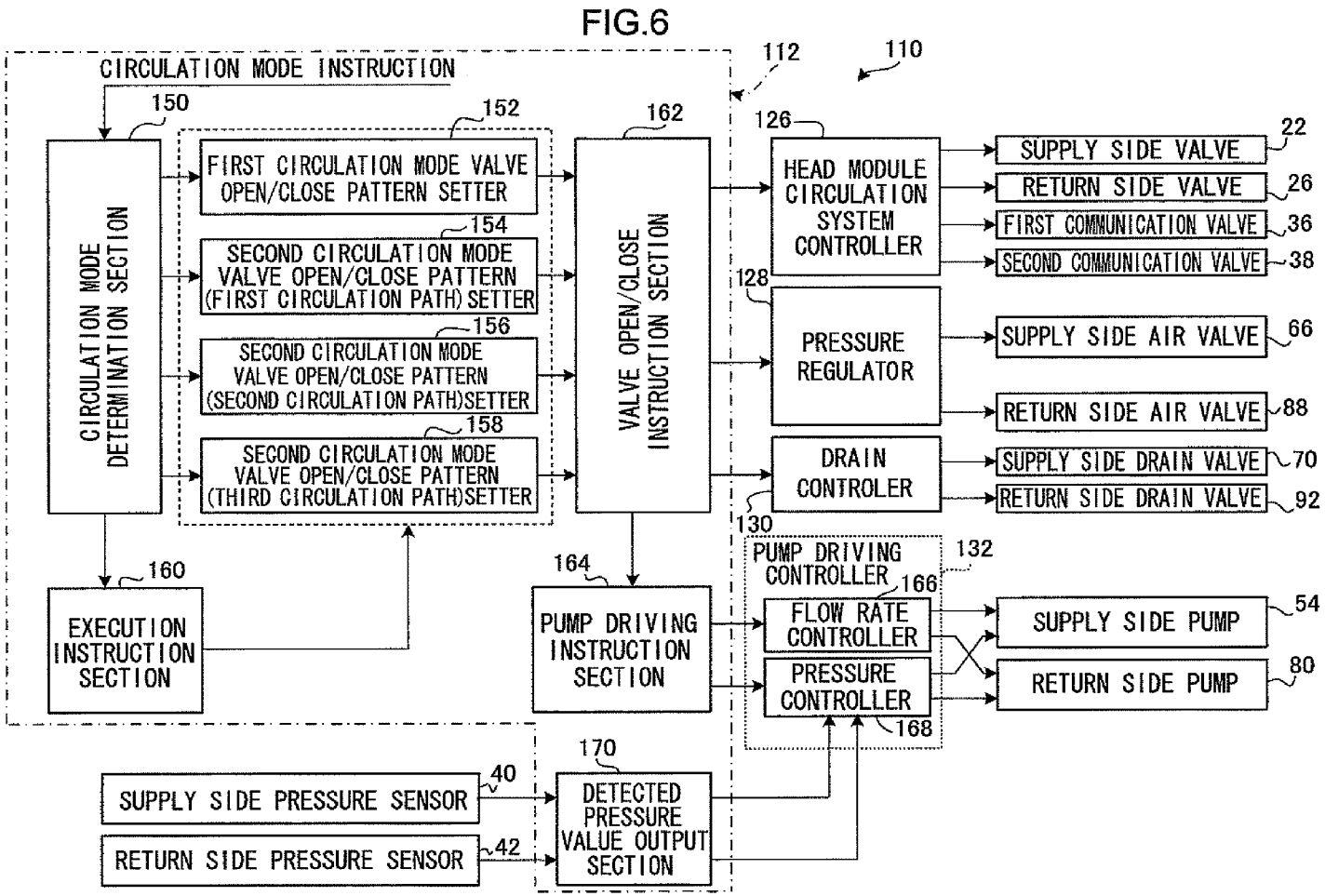
FIG. 6 is a functional block diagram of an ink supply control device according to the present exemplary embodiment for executing an ink circulation system program.

A functional block diagram is shown in FIG. 6 for executing the ink circulation system programs in the ink supply control device 110. The functional block diagram is one in which the functions have been separated into blocks, and does not imply any limitations in hardware configuration. In the present exemplary embodiment, for example, in the main software programs are executed by the microcomputer 112 of the ink supply control device 110.

As shown in FIG. 6, configuration is made such that a circulation instruction is input to a circulation mode determination section 150 of the ink supply control device 110.

The state of the circulation instruction is analyzed in the circulation mode determination section 150. In the circulation mode determination section 150, when circulation control by pressure control is instructed, namely a circulation mode is instructed after power has been turned on during standby (print standby), this being a print enabled state, an activation instruction signal is output to a first circulation mode valve open/close pattern setter 152.

When circulation control by flow rate control is instructed, namely, when either power is switched on after a specific period has elapsed from turning the power off, periodically during standby, or execution instruction is made by a user, an activation signal is output to the second circulation mode valve open/close pattern setters 154, 156, 158.

There are three types of second circulation mode valve open/close patterns here (the first to third circulation paths), and in the circulation mode determination section 150, as well as an activation signal being output to the second circulation mode valve open/close pattern setters 154, 156, 158, a time series switching signal is output to an execution instruction section 160 with the predetermined sequence that is required for setting valve opening and closing by the second circulation mode valve open/close pattern setters 154, 156, 158.

First, the execution instruction section 160 activates the second circulation mode valve open/close pattern (first circulation path) setter 154, and the first circulation path is configured.

Then, the execution instruction section 160 activates the second circulation mode valve open/close pattern (second circulation path) setter 156, and the second circulation path is configured.

Finally, the execution instruction section 160 activates the second circulation mode valve open/close pattern (third circulation path) setter 158, and the third circulation path is configured.

The switching time for the circulation paths in the execution instruction section 160 is executed based on the circulation instruction input from the circulation mode determination section 150.

The first circulation mode valve open/close pattern setter 152 and the second circulation mode valve open/close pattern setters 154, 156, 158 are respectively connected to a valve open/close instruction section 162.

The valve open/close instruction section 162 is connected to the head module circulation system controller 126, the pressure regulator 128 and the drain controller 130, respectively.

The valve open/close instruction section 162, based on the valve open/close instructions from the first circulation mode valve open/close pattern setter 152 and the second circulation mode valve open/close pattern setters 154, 156, 158, controls opening and closing of the supply side valve 22, the return side valve 26, the first communication valve 36 and the second communication valve 38 through the head module circulation system controller 126, controls opening and closing of the supply side air valve 66 and the return side air valve 88 through the pressure regulator 128, and controls the opening and closing of the supply side drain valve 70 and the return side drain valve 92 through the drain controller 130.

The valve open/close instruction section 162 is connected to a pump driving instruction section 164, and after valve opening and closing instruction, the valve open/close instruction section 162 outputs a driving instruction to whichever needs to be driven of the supply side pump 54 and/or the return side pump 80.

The pump driving instruction section 164 is connected to a flow rate controller 166 and a pressure controller 168 of the pump driving controller 132, and outputs a execution instruction to one or other thereof based on the instructed circulation mode.

The supply side pump 54 and the return side pump 80 are respectively connected to both the flow rate controller 166 and the pressure controller 168. A detected pressure value output section 170 is connected to the pressure controller 168. The supply side pressure sensor 40 and the return side pressure sensor 42 are connected to this detected pressure value output section 170, such that detection signals from the supply side pressure sensor 40 and the return side pressure sensor 42 are input to the pressure controller 168.

Explanation follows regarding operation of the present exemplary embodiment.

In the present exemplary embodiment, as shown in FIG. 7, a valve open/close pattern table 118A for the first circulation mode and the second circulation mode (first to third circulation paths) is stored in advance on the ROM 118.

Figure 8:
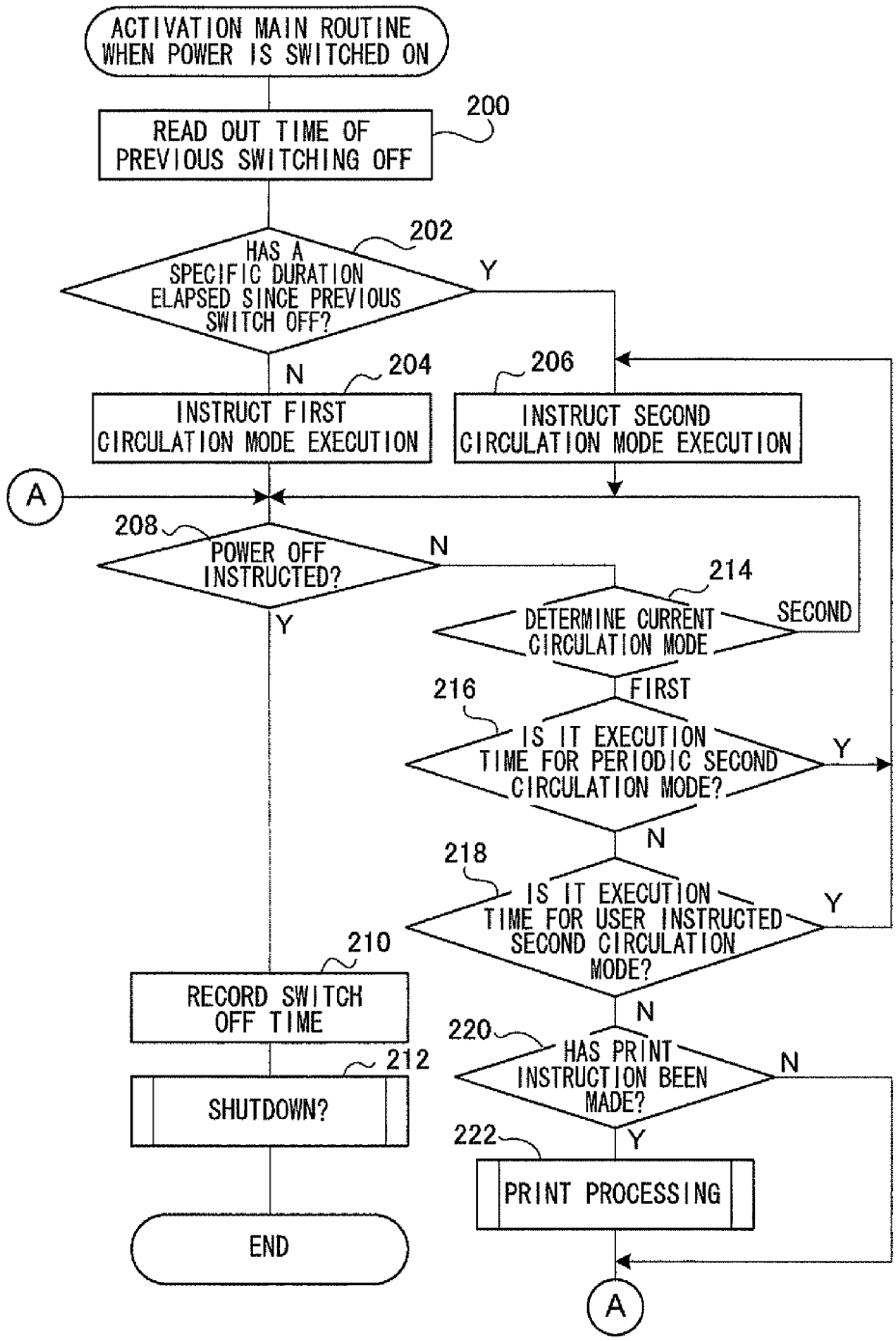
Figure 9:
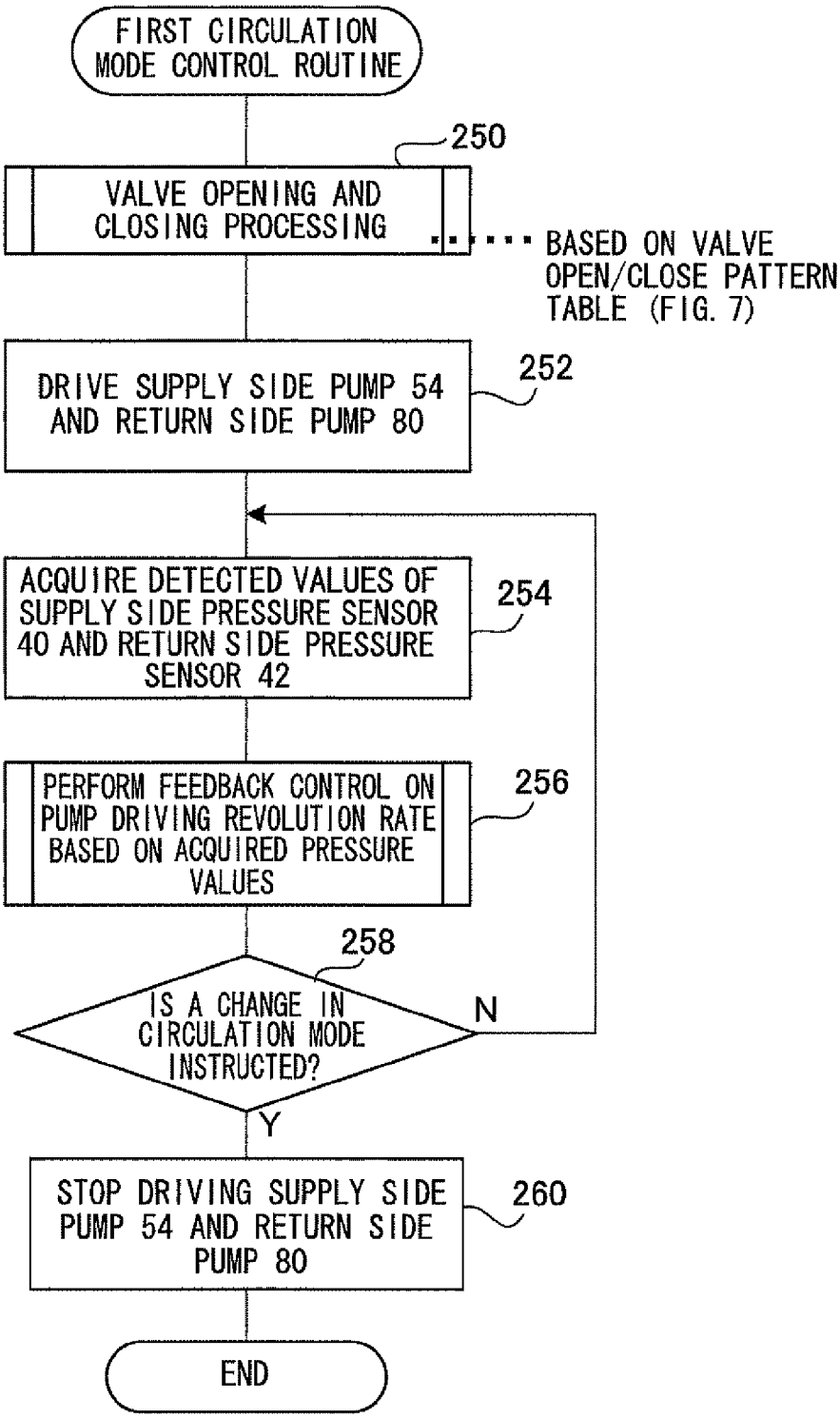
FIG. 9 is a flow chart showing a first circulation mode control routine according to the present exemplary embodiment.
Figure 10:
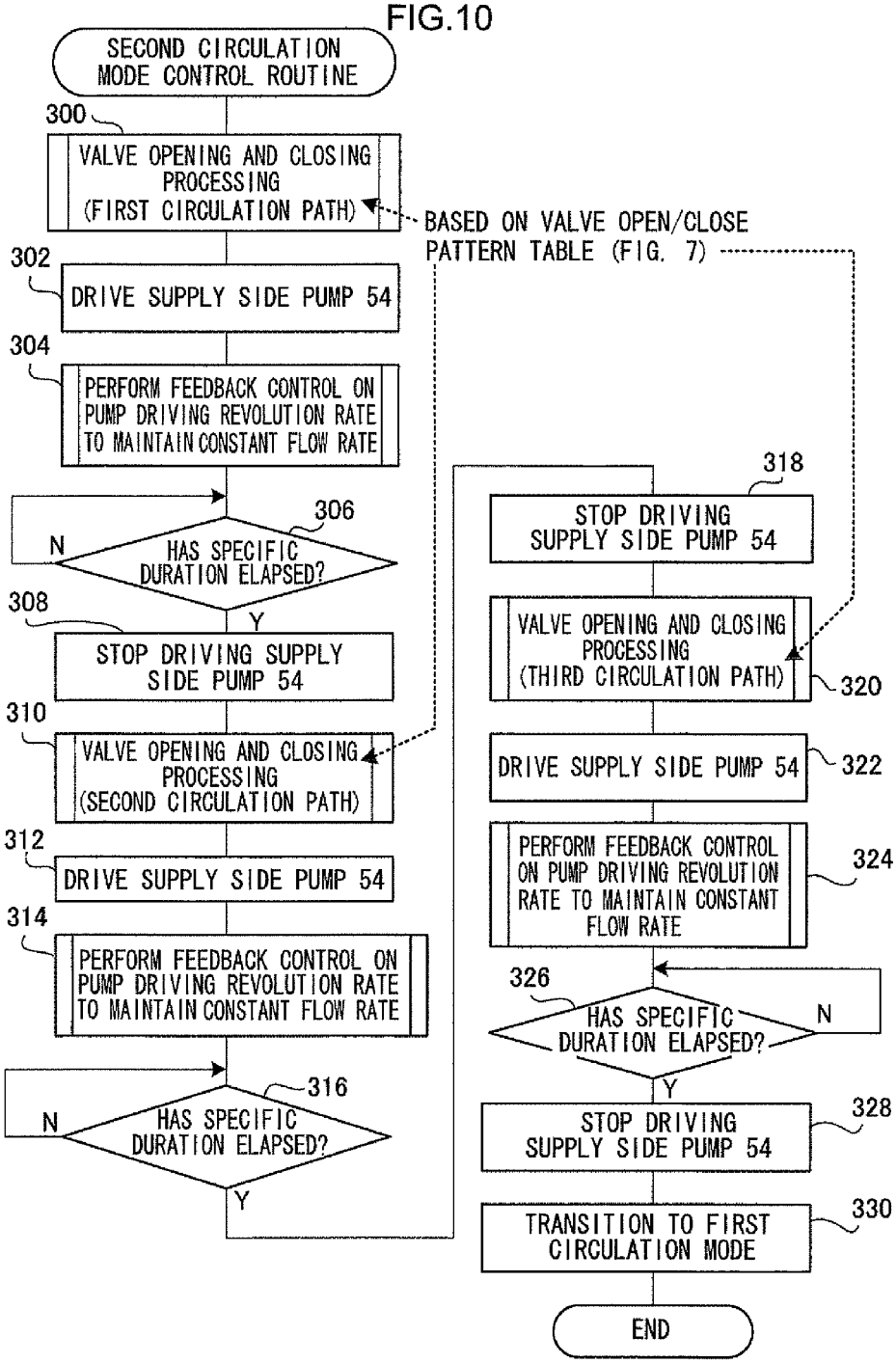
FIG. 10 is a flow chart showing a second circulation mode control routine according to the present exemplary embodiment.

FIG. 8 to FIG. 10 are flow charts of the processing flow for executing circulation control of the circulation mode based on pressure control and flow rate control in the ink supply control device 110.

FIG. 8 is a flow chart showing a main routine for circulation control activated when power is switched on.

At step 200, the time of previous switching off is read out, then processing proceeds to step 202 where determination is made as to whether or not a specific duration or greater has elapsed since the time of previous switching off. When negative determination is made at step 202, this is determined as meaning that forced circulation for gas bubble purging is not required, processing proceeds to step 204 where an instruction for first circulation mode is output, and then processing proceeds to step 208.

When affirmative determination is made at step 202 this means that ink has been standing for a long duration and gas bubbles are expected to have been generated, processing proceeds to step 206 where an instruction for second circulation mode, this being forced circulation, is output, and then processing proceeds to step 208.

Determination is made at step 208 as to whether or not instruction has been made to switch off the power. When affirmative determination is made at step 208, processing proceeds to step 210 where the time of switching off is recorded. Processing then proceeds to step 212 where shut down is performed and this routine is ended.

When negative determination is made at step 208 processing proceeds to step 214. At step 214, determination is made as to whether the current circulation mode is the first circulation mode or the second circulation mode. Namely, in the present exemplary embodiment, since the print (image forming) standby state is the first circulation mode, always either the first circulation mode is executed or the second circulation mode is executed.

At step 214, when the current mode is determined to be the second circulation mode, processing returns to step 208.

When determination is made at step 214 that the circulation mode is the first circulation mode, processing proceeds to step 216.

At step 216, determination is made as to whether or not it is the execution time for the periodic second circulation mode, and when affirmative determination is made processing proceeds to step 206, and an instruction to execute the second circulation mode is given. When negative determination is made at step 216, processing proceeds to step 218.

At step 218, determination is made as to whether or not instruction to execute the second circulation mode has been specified by a user, and when affirmative determination is made processing proceeds to step 206 and an instruction to execute the second circulation mode is given. When negative determination is made at step 218 processing proceeds to step 220.

At step 220, determination is made as to whether or not print instruction has been made, and when negative determination is made processing returns to step 208 and the above processes are repeated. When affirmative determination is made at step 220, processing proceeds to step 222 where print processing is executed, and then processing returns to step 208 and the above processes are repeated.

FIG. 9 is a flow chart showing a first circulation mode control routine.

At step 250, valve opening and closing is executed based on the valve open/close pattern table shown in FIG. 7. As a result, the circulation path for the first circulation mode shown in FIG. 4 is configured.

At the next step 252, the supply side pump 54 and the return side pump 80 are driven, and circulation of the ink is commenced. Ink is circulated as shown by the bold broken lines of FIG. 4 due to driving the supply side pump 54 and the return side pump 80.

In the next step 254, the detection values of the supply side pressure sensor 40 and the return side pressure sensor 42 are acquired. Processing next proceeds to step 256 where feed back control of the pump driving revolution rate is performed based on the acquired pressure value, then processing proceeds to step 258. Namely, in the first circulation mode, both the supply side pump 54 and the return side pump 80 are driven, and circulation is made while the nozzle back pressure of the head modules 12 is made constant and maintained as a negative pressure.

In step 258, determination is made as to whether or not change to the circulation mode has been instructed, and when negative determination is made, processing returns to step 254, and the above processes are repeated. Namely, the first circulation mode is always executed as the standby mode for printing (image forming), with feedback control of the pump driving revolution rate reflecting pressure fluctuations arising due to the ejection rate from the nozzles during printing. When affirmative determination is made at step 258, processing proceeds to step 260, driving of the supply side pump 54 and the return side pump 80 is temporarily stopped, and the routine ended. Note that configuration may be made such that driving of the supply side pump 54 and the return side pump 80 continues as it is.

FIG. 10 is a flow chart showing a second circulation mode control routine.

In step 300, valve opening and closing is executed based on the valve open/close pattern table shown in FIG. 7. As a result, the first circulation path of the second circulation mode is configured as shown in FIG. 5A.

In the next step 302, the supply side pump 54 is driven and circulation of the ink is commenced. The ink is circulated as shown by the bold broken lines of FIG. 5A due to driving the supply side pump 54.

At the next step 304, feedback control of the pump driving revolution rate is executed to maintain a constant flow rate, then processing proceeds to step 306.

At step 306, determination is made as to whether or not a specific duration has elapsed, and processing proceeds to step 308 when affirmative determinate is made, driving of the supply side pump 54 is stopped, and then processing proceeds to step 310.

At step 310, valve opening and closing is executed based on the valve open/close pattern table shown in FIG. 7. As a result, the second circulation path in the second circulation mode is configured as shown in FIG. 5B.

At the next step 312, the supply side pump 54 is driven and circulation of the ink is commenced. The ink is circulated by this driving of the supply side pump 54 as shown by the bold broken lines of FIG. 5B.

In the next step 314, feedback control of the pump driving revolution rate is executed to maintain a constant flow rate and then processing proceeds to step 316.

At step 316, determination is made as to whether or not a specific duration has elapsed, when affirmative determination is made processing proceeds to step 318, driving of the supply side pump 54 is stopped, and processing proceeds to step 320.

At step 320, valve opening and closing is executed based on the valve open/close pattern table shown in FIG. 7. As a result, the third circulation path in the second circulation mode is configured as shown in FIG. 5C.

At the next step 322, the return side pump 80 is driven, and circulation of the ink is commenced. The ink is circulated by this driving of the return side pump 80 as shown by the bold broken lines of FIG. 5C.

At the next step 324, feedback control of the pump driving revolution rate is executed to maintain a constant flow rate, then processing proceeds to step 326.

At step 326, determination is made as to whether or not a specific duration has elapsed, and when affirmative determination is made, processing proceeds to step 328, driving of the return side pump 80 is stopped, and processing proceeds to step 330.

At step 330, transition is made to the first circulation mode and this routine is ended.

What is claimed is:

1. A liquid droplet circulation control apparatus comprising:

a first circulation controller that sets a first circulation mode in which liquid is circulated with pressure control by driving a supply side pressure generator and a return side pressure generator that are disposed on either side of a liquid droplet ejector comprising nozzles for ejecting liquid droplets, a negative pressure for a back pressure of the nozzles being maintained during the circulation of the liquid, the supply side pressure generator supplying the liquid, which is a collection of the liquid droplets, to the liquid droplet ejector and the return side pressure generator returning the liquid from the liquid droplet ejector;

a second circulation controller that sets a second circulation mode in which the liquid is circulated with flow rate control by driving the supply side pressure generator and/or the return side pressure generator, such that the liquid is not supplied to the liquid droplet ejector or is made to bypass at least the liquid droplet ejector;

a selector that selects one of the first circulation mode and the second circulation mode; and a setting unit that sets a circulation path of the liquid based on the circulation mode selected by the selector, wherein the second circulation controller selects and sets a circulation path that is one of:

the first circulation path that includes a supply side pipe path for supplying the liquid to the liquid droplet ejector and a return side pipe path for returning the liquid from the liquid droplet ejector, and does not include the liquid droplet ejector;

the second circulation path that includes the supply side pipe path alone; or the third circulation path that includes the return side pipe path alone.

2. A liquid droplet ejection apparatus comprising:

a liquid droplet ejection controller that comprises a liquid droplet ejector comprising nozzles for ejecting liquid droplets, a supply side pipe path section configured by a supply side path for supplying a liquid, which is a collection of the liquid droplets stored in a storage tank, to the liquid droplet ejector by driving of a supply side pressure generator, and a return side pipe path section for returning to the storage tank the liquid supplied to the liquid droplet ejector by driving of a return side pressure generator, the liquid droplet ejection controller controlling ejection of the liquid droplets from the nozzles of the liquid droplet ejector based on an input signal;

a first circulation controller that sets a first circulation mode in which the liquid is circulated with pressure control by driving the supply side pressure generator and the return side pressure generator that are disposed on either side of the liquid droplet ejector, while maintaining a negative pressure for a back pressure of the nozzles;

a second circulation controller that sets a second circulation mode in which the liquid is circulated with flow rate control by driving the supply side pressure generator and/or the return side pressure generator, such that a supply side pipe path section and a return side pipe path section is communicated so that the liquid is not supplied to the liquid droplet ejector or is made to bypass at least the liquid droplet ejector;

a selector that selects one of the first circulation mode and the second circulation mode; and a setting unit that sets a circulation path of the liquid based on the circulation mode selected by the selector, wherein the second circulation controller selects and sets a circulation path that is one of:

the first circulation path that includes the supply side pipe path and the return side pipe path, and does not include the liquid droplet ejector;

the second circulation path that includes the supply side pipe path alone; or the third circulation path that includes the return side pipe path alone.

3. The liquid droplet ejection apparatus of claim 2, wherein the first circulation mode is a standby mode in which liquid droplet ejection control is made to standby.

4. A computer readable storage medium stored with a program for executing liquid droplet circulation control on a computer, the liquid droplet circulation control comprising:

setting a first circulation mode in which liquid is circulated with pressure control by driving a supply side pressure generator and a return side pressure generator that are disposed on either side of a liquid droplet ejector comprising nozzles for ejecting liquid droplets, a negative pressure for a back pressure of the nozzles being maintained during the circulation of the liquid, the supply side pressure generator supplying a liquid, which is a collection of the liquid droplets, to the liquid droplet ejector and the return side pressure generator returning the liquid from the liquid droplet ejector;

setting a second circulation mode in which the liquid is circulated with flow rate control by driving the supply side pressure generator and/or the return side pressure generator, so that the liquid is not supplied to the liquid droplet ejector or is made to bypass at least the liquid droplet ejector;

selecting one of the first circulation mode and the second circulation mode; and setting a circulation path of the liquid based on the circulation mode selected by the selector, wherein setting a second circulation mode comprises selecting and setting a circulation path that is one of:

the first circulation path that includes a supply side pipe path for supplying the liquid to the liquid droplet ejector and a return side pipe path for returning the liquid from the liquid droplet ejector, and does not include the liquid droplet ejector;

the second circulation path that includes the supply side pipe path alone; or the third circulation path that includes the return side pipe path alone.

* * * * *